US009730495B2

(12) United States Patent
Howell

(10) Patent No.: US 9,730,495 B2
(45) Date of Patent: Aug. 15, 2017

(54) SIDE-RELEASE BUCKLE

(71) Applicant: Here Be Dragons, LLC, Bridgton, ME (US)

(72) Inventor: Frank A. Howell, Sweden, ME (US)

(73) Assignee: HERE BE DRAGONS, LLC, Bridgton, ME (US)

( * ) Notice: Subject to any disclaimer, the term of this patent is extended or adjusted under 35 U.S.C. 154(b) by 0 days.

(21) Appl. No.: 14/951,733

(22) Filed: Nov. 25, 2015

(65) Prior Publication Data

US 2016/0157564 A1 Jun. 9, 2016

Related U.S. Application Data

(60) Provisional application No. 62/089,414, filed on Dec. 9, 2014.

(51) Int. Cl.
*A44B 11/25* (2006.01)
*A44B 11/26* (2006.01)

(52) U.S. Cl.
CPC ..... *A44B 11/266* (2013.01); *A44B 11/25* (2013.01)

(58) Field of Classification Search
CPC ... A44B 11/266; A44B 11/25; A44D 2200/12; Y10S 24/38; Y10T 24/45529; Y10T 24/45152
See application file for complete search history.

(56) References Cited

U.S. PATENT DOCUMENTS 4,569,106 A * 2/1986 Lovato ..... A44B 11/266 24/587.12
4,621,393 A * 11/1986 Ambal ..... A44B 11/266 24/171
4,779,315 A * 10/1988 Kohus ..... A44B 11/266 24/587.12
5,203,058 A * 4/1993 Krauss ..... A44B 11/266 24/587.12
5,735,024 A * 4/1998 Ortiz ..... A44B 11/266 24/573.11
D455,101 S * 4/2002 Hamilton ..... D11/220
6,484,372 B2 * 11/2002 Novak ..... A44B 11/2592 24/312

(Continued)

*Primary Examiner* — Robert J Sandy
*Assistant Examiner* — Rowland Do
(74) *Attorney, Agent, or Firm* — Gesmer Updegrove LLP

(57) ABSTRACT

A buckle has two identical components relatively shiftable along a central axis into and out of an assembled state, with an interlocking mechanism for releasably coupling the components in their assembled state. The interlocking mechanism includes a wing on each of the components. The wings have opposed mutually spaced resilient panels defining passages therebetween leading to aligned locking surfaces. Each component also has a prong with oppositely protruding posts and first and second cam surfaces. The first cam surfaces are configured and arranged to urge the panels apart and thereby accommodate insertion of the prongs into the passages to locked positions at which the posts are in snap engagement with the locking surfaces. The second cam surfaces are configured and arranged to act in response to flexure of the prongs towards the central axis to urge the panels apart and to thereby accommodate withdrawal of the prong from the passages.

10 Claims, 8 Drawing Sheets

(56) References Cited

U.S. PATENT DOCUMENTS

| | | | | |
|---|---|---|---|---|
| 6,571,434 | B2 * | 6/2003 | Ortiz | A44B 11/006<br>24/265 BC |
| 6,826,806 | B2 * | 12/2004 | Eaton | A44B 11/25<br>24/115 F |
| 7,290,313 | B2 * | 11/2007 | Southern | A44B 11/266<br>24/587.12 |
| 7,445,293 | B2 * | 11/2008 | Smith | B60N 2/2812<br>24/614 |
| 2002/0029443 | A1 * | 3/2002 | Ortiz | A44B 11/006<br>24/615 |
| 2003/0121129 | A1 * | 7/2003 | Hamilton | A44B 11/266<br>24/615 |
| 2003/0217441 | A1 * | 11/2003 | Eaton | A44B 11/25<br>24/115 F |
| 2009/0119890 | A1 * | 5/2009 | Laruccia | A44B 11/266<br>24/586.1 |
| 2011/0193396 | A1 * | 8/2011 | Friedman | B60N 2/2812<br>297/484 |
| 2013/0333634 | A1 * | 12/2013 | Rosenquist | A44B 11/263<br>119/865 |
| 2016/0166016 | A1 * | 6/2016 | Osterberg | A44B 11/266<br>24/577.1 |

* cited by examiner

FIG. 10
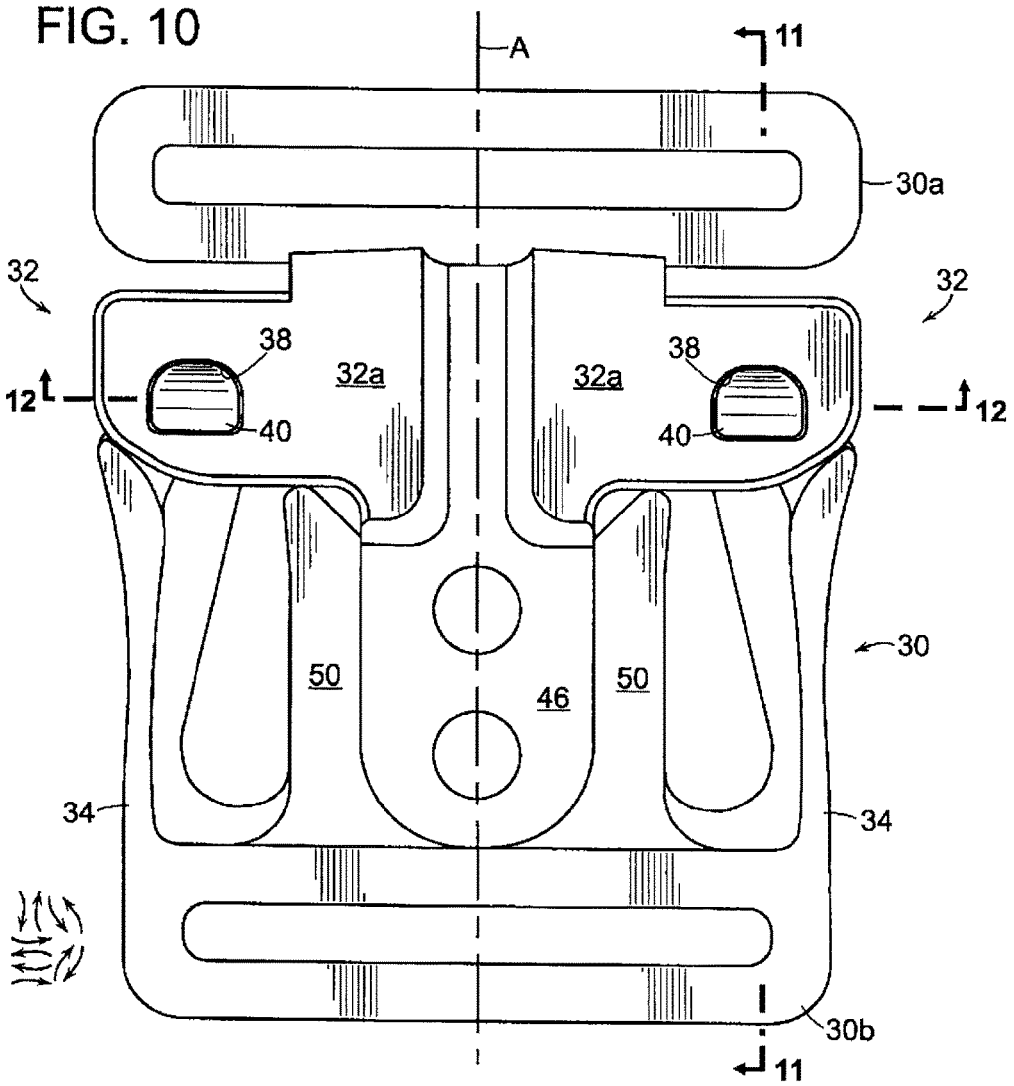
FIG. 11
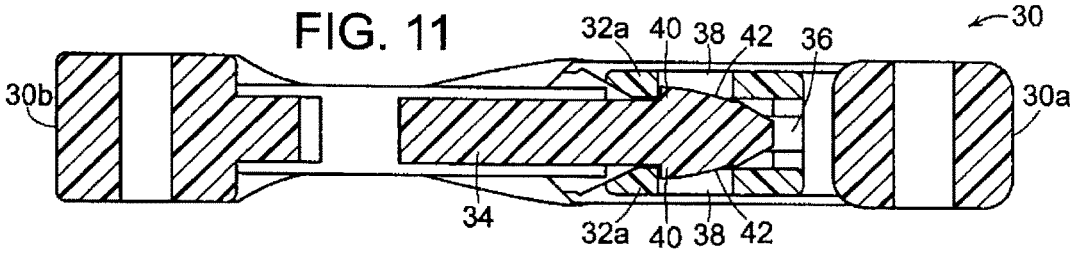
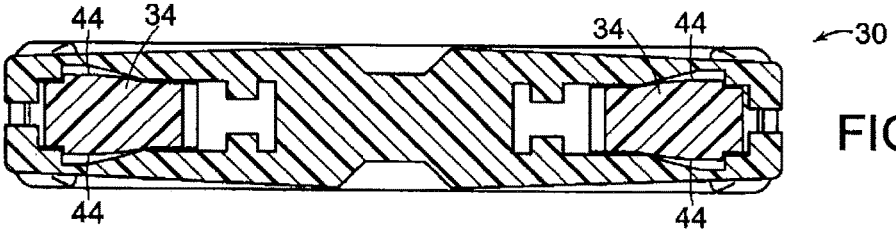
FIG. 12

SIDE-RELEASE BUCKLE

CROSS REFERENCE TO RELATED APPLICATIONS

This application claims priority from U.S. Provisional Application Ser. No. 62/089,414, filed on Dec. 9, 2014, the entire contents and substance of which are herein incorporated by reference.

FIELD OF THE INVENTION

This invention relates generally to buckles for joining and releasing the ends of web straps or other various articles when surface mounted, and is concerned in particular with two part side-release type buckles.

DESCRIPTION OF RELEVANT ART

The side-release type buckle is innately useful because it can be easily parted by squeezing opposing surfaces with the thumb and forefinger. The two opposing forces applied to open the buckle cancel each other out; the buckle does not tend to move and does not have to be pinioned or otherwise restrained when operated.

A typical example of a side-release type buckle is described in U.S. Pat. No. 4,150,464 (Tracy). In the Tracy buckle the male side has two opposing prongs with exterior catch surfaces that pass into a female side with opposing slot openings that catch the prongs once inserted. The buckle is typically parted by thumb and forefinger pushing the exposed male surfaces inward and off the slot-created edges of the female.

Although Tracy type buckles are based on sound design principles, in use they suffer from a number of drawbacks. For example, the Tracy side-release design has limited ability to carry heavy loads. When joining the buckle's halves, the male's prongs must first flex inward to pass into the female's cavity then rebound outward to engage the female's slot locking surfaces. Under heavy load, the male's prongs are flexed inward by the misalignment of the female's outboard engaging surfaces and the inboard loading point at the base of the male's prongs. As the load increases the prongs continue to flex inward until the buckle spontaneously parts.

Angled (mirror-image) locking surfaces were added to cause the prong and slot locking surfaces to draw together when placed under load. While effective at keeping the buckle from spontaneously opening, these angled locking surfaces did not allow the buckle to be easily parted under heavy load. The prongs had to be pushed hard enough to overcome the applied load to draw the female and male sides together before the locking surfaces would disengage.

Another approach was to move the catching surfaces to an area near the tips of the prongs where the female's catch surfaces were better aligned with the bases of the prongs. This configuration helped to minimize heavy load induced distortion of the prongs, but by doing so, the physical strength of the catch surfaces were somewhat compromised because loading was no longer supported by the robust outboard sides of the female's slots.

Also, during release, the thumb and forefinger can be subjected to pinching as the prong's catch surfaces flex past the female's slot surfaces. This liability is exacerbated when the buckle is under heavy load.

SUMMARY OF THE INVENTION

Broadly stated, the objective of the present invention is to retain the side-release functionality of Tracy type buckles while eliminating or at least substantially and beneficially minimizing its associated drawbacks as described above.

To this end, a buckle in accordance with the present invention comprises two components relatively shiftable along a central axis into and out of an assembled state. Interlocking means releasably couples the components in the assembled state. The interlocking means comprises at least one wing on one of the components. The wing has opposed mutually spaced resilient panels defining a passage therebetween leading to aligned locking surfaces on the panels. At least one resilient prong is provided on the other of the components. The prong has oppositely protruding posts and first and second cam surfaces. The first cam surfaces are configured and arranged to urge the panels apart to thereby accommodate insertion of the prong into the passage to a locked position at which the posts are in snap engagement with the locking surfaces. In this position each panel applies opposing spring pressure, thus clutching the prong and stabilizing the assembly in two ways: 1) When the assembly is not under load the pressure between the panels maintains a snug fit that eliminates rattling. 2) When under load the tendency for the panels to warp and twist under edgewise force is counteracted as each panel works in opposition to the other to distribute the applied load. The second cam surfaces are configured and arranged to act in response to flexure of the prong towards the central axis to urge the panels apart and to thereby accommodate withdrawal of the prong from the passage. The panels are relatively thin to allow them to flex apart easily to accommodate withdrawal, yet robust edgewise to support loading on the assembly. The locking surfaces may be defined by peripheral edges of the panels.

Alternatively, the panels may be provided with openings for receiving the posts, with the locking surfaces being defined by edges of the openings.

Preferably, the two buckle components are identically configured, with each component having one wing and one prong. This arrangement allows any two components to be assembled, eliminating component mismatches.

Alternatively, the two buckle components have dissimilar designs, with one component having two wings and the other component having two prongs.

Exemplary embodiments of the present invention will now be described in greater detail with reference to the accompanying drawings, wherein:

BRIEF DESCRIPTION OF THE DRAWINGS

FIG. 10 is a top plan view of the buckle illustrated in FIG. 9;

FIGS. 11 and 12 are sectional views taken respectively along lines 11-11 and 12-12 of FIG. 10;

DETAILED DESCRIPTION

Figure 1:
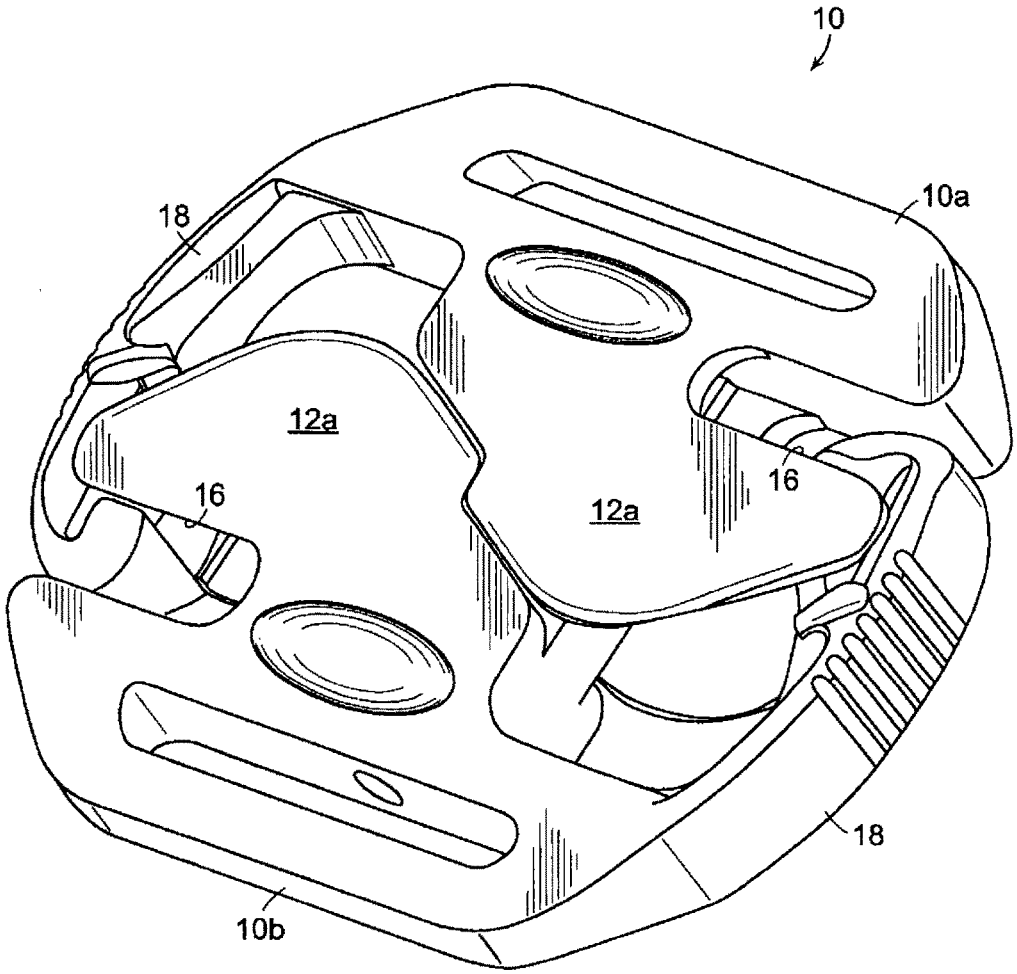
FIG. 1 is a perspective view of a buckle in accordance with a first exemplary embodiment of the present invention.
Figure 2:
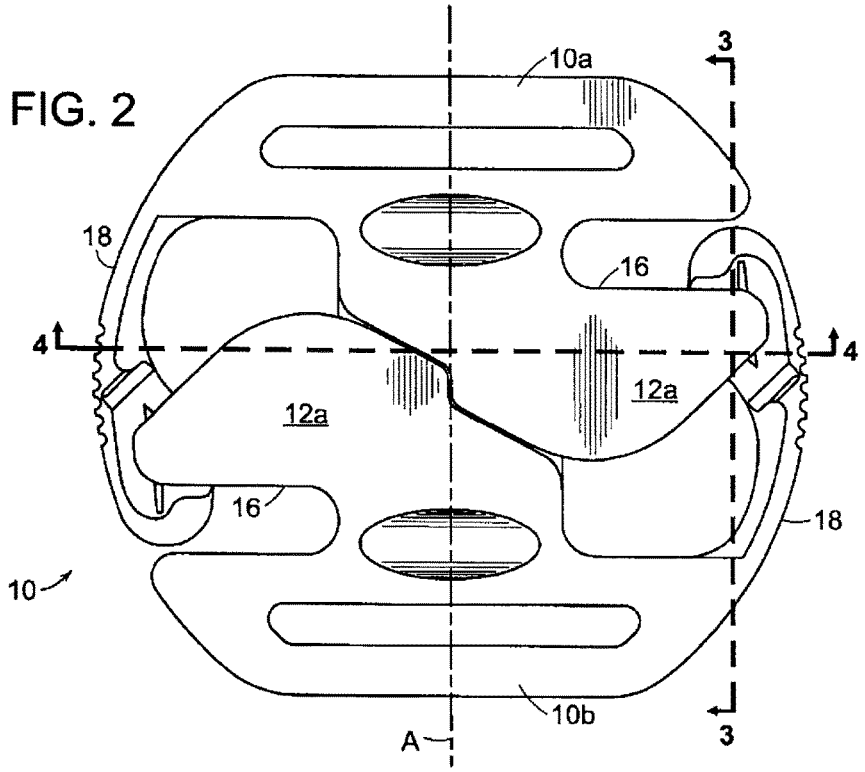
FIG. 2 is a top plan view of the buckle illustrated in FIG. 1.
Figure 5:
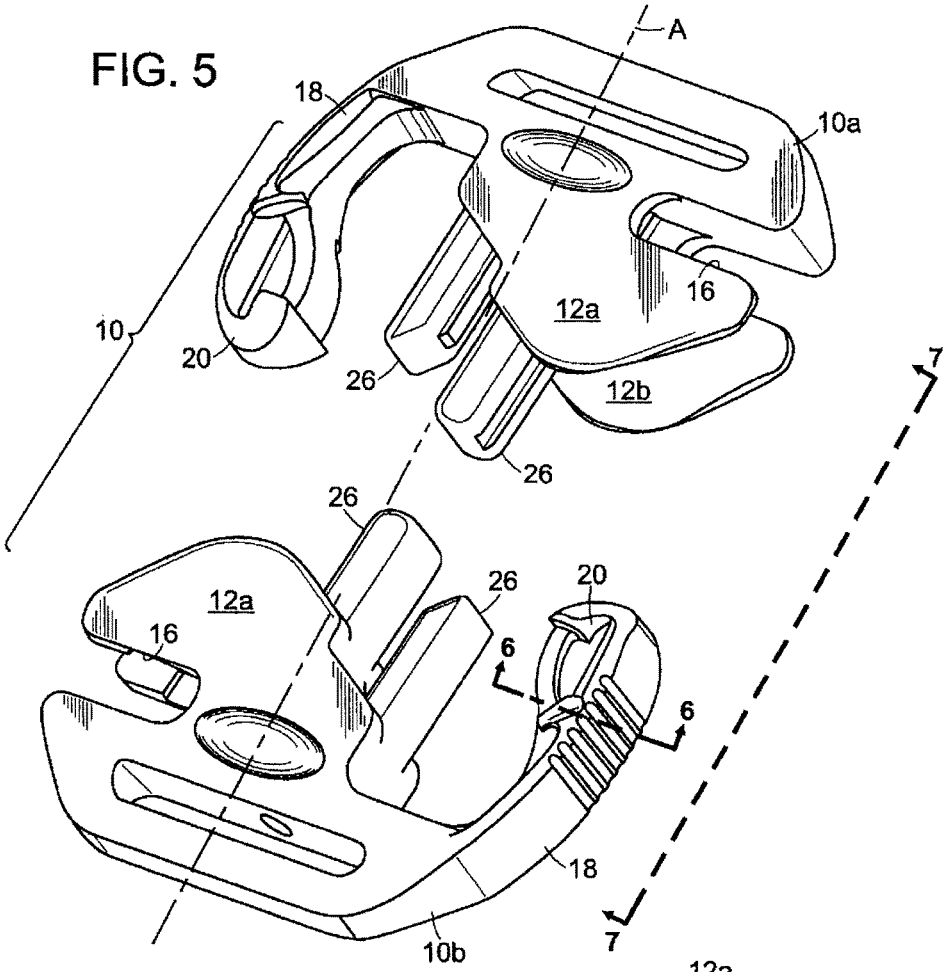
FIG. 5 is a perspective view showing the two components of the buckle of FIG. 1 separated from each other in a disassembled state.

With reference initially to FIG. 1-7, a buckle in accordance with a first exemplary embodiment of the present invention is generally depicted at 10. The buckle comprises two identical components 10*a*, 10*b* which are relatively shiftable along a central axis "A" between an assembled state as shown in FIG. 1 and a separated disassembled state as shown in FIG. 5.

An interlocking means serves to releasably couple the components 10*a*, 10*b* in the assembled state shown in FIG. 1. The interlocking means of the buckle 10 comprises a wing generally depicted at 12 in FIG. 5 on each buckle component 10*a*, 10*b*. The wings 12 comprise mutually spaced resilient panels 12*a*, 12*b* defining passages 14 therebetween. Passages 14 leads to aligned locking surfaces, in this case the rear edges 16 of the panels 12*a*, 12*b*.

Figure 3:
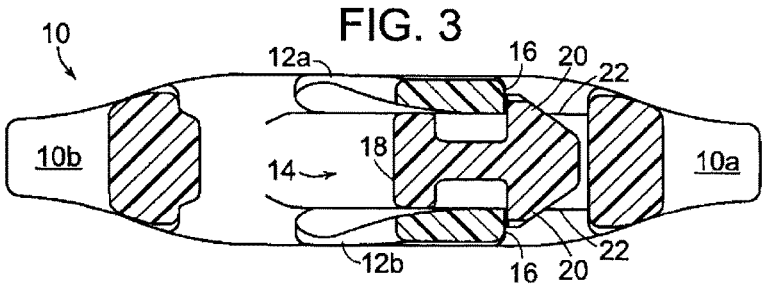
FIGS. 3 and 4 are sectional views taken respectively along lines 3-3 and 4-4 of FIG. 2.
Figure 4:
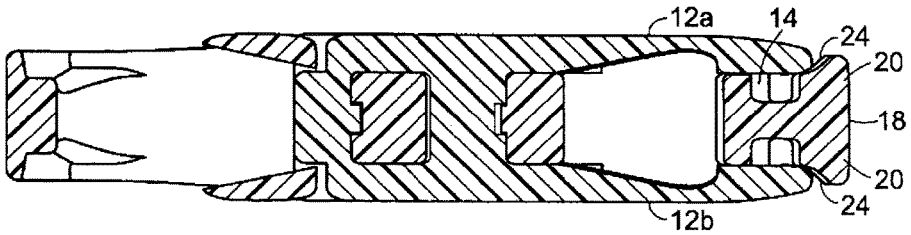
Figure 8:
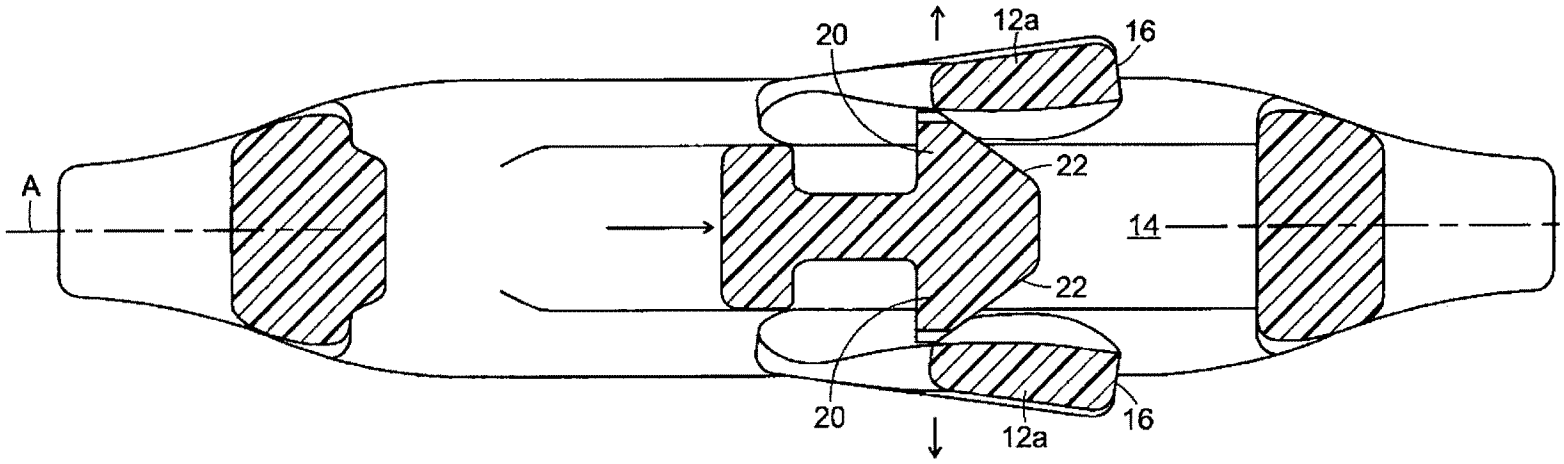
FIG. 8 is a longitudinal sectional view diagrammatically depicting the spreading of the resilient wing panels during assembly of the buckle components.

The interlocking means of the buckle 10 further comprises a resilient prong 18 on each buckle component 10*a*, 10*b*. As can be best seen in FIGS. 3 and 4, the prongs 18 have oppositely protruding posts 20 and first and second cam surfaces 22, 24. With reference to FIG. 8, as the buckle components 10*a*, 10*b* are brought together along axis A, the first cam surfaces 22 are configured and arranged to urge the wing panels 12*a*, 12*b* apart to accommodate insertion of the prongs 18 into passages 14. As the prongs exit the rear ends of passages 14, and as shown in FIG. 3, the posts 20 are snap engaged by the rear panel edges 16, thus interlocking the buckle components 10*a*, 10*b* in the assembled state.

Figure 6:
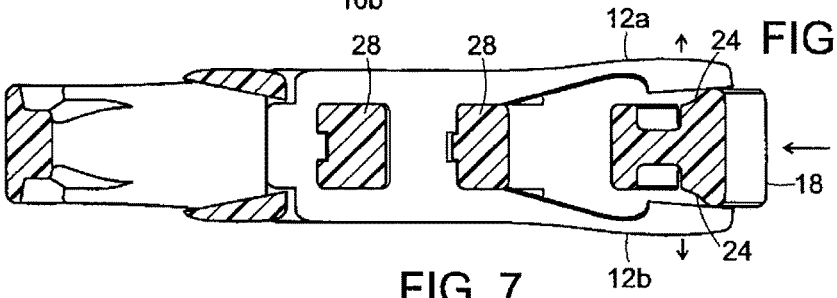
FIG. 6 is a sectional view similar to FIG. 4 showing the wing panels being urged apart by inward flexure of a prong.
Figure 7:
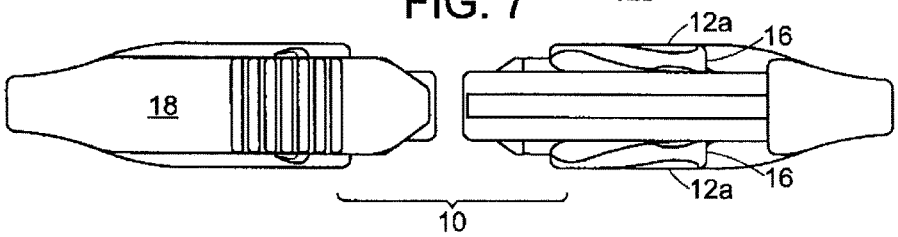
FIG. 7 is a side view of the separated buckle components shown in FIG. 6.

In order to disassemble the buckle components 10*a*, 10*b*, the resilient prongs 18 are pressed inwardly towards axis A. As depicted in FIG. 6, the second cam surfaces 24 urge the panels 12*a*, 12*b* apart, which disengages the rear panel edges 16 from the posts 20, thereby accommodating withdrawal of the prongs 18 from the passages 14.

Laterally spaced longitudinally projecting guide bars 26 with sides configured to provide tongue and groove interfaces 28 (best seen in FIG. 6) assist in aligning and smoothly sliding the two buckle components together.

Figure 9:
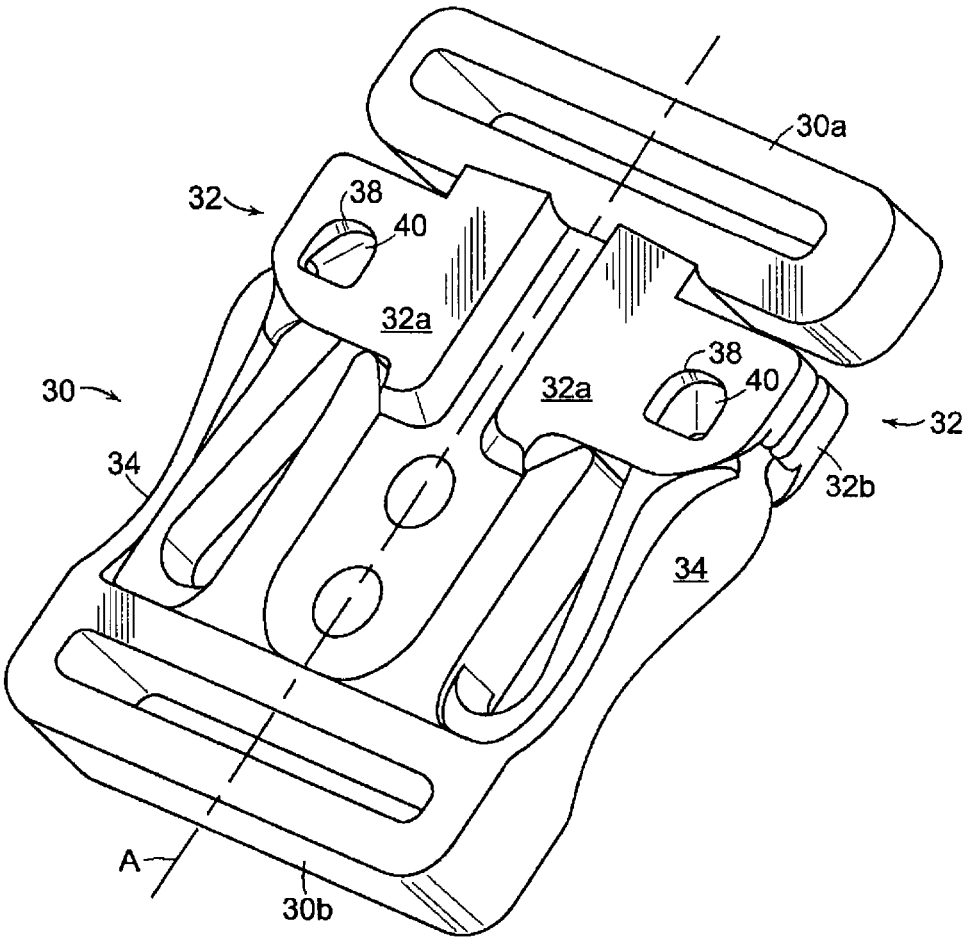
FIG. 9 is a perspective view of a buckle in accordance with a second exemplary embodiment of the present invention.
Figure 13:
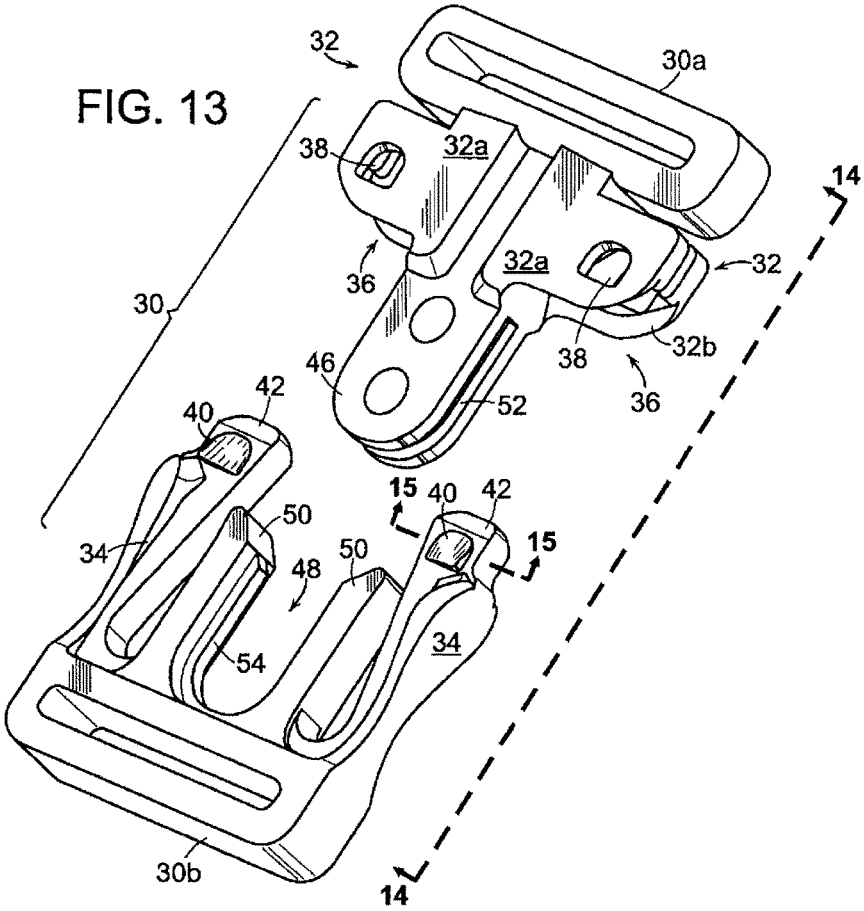
FIG. 13 is a perspective view showing the two components of the buckle of FIG. 9 separated from each other in a disassembled state.
Figure 14:
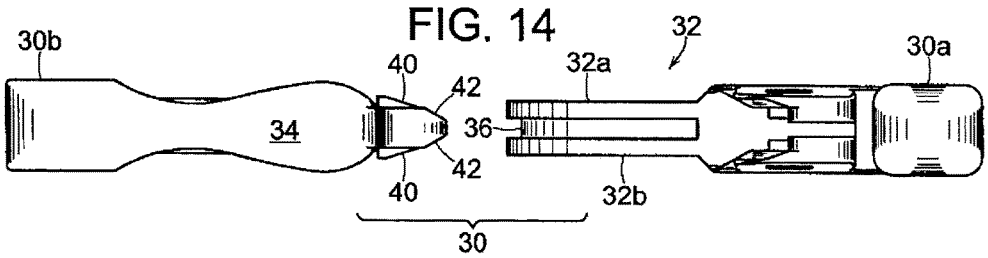
FIG. 14 is a side view of the separated buckle components shown in FIG. 13.
Figure 15:
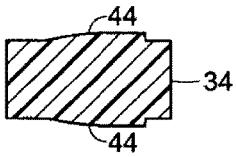
FIG. 15 is a sectional view taken along line 15-15 of FIG. 13.

With reference to FIGS. 9-16, a buckle in accordance with a second exemplary embodiment of the present invention is generally depicted at 30. The buckle 30 comprises two differently configured components 30*a*, 30*b* which again are relatively shiftable along a central axis "A" between an assembled state as shown in FIGS. 9 and 10 and a disassembled state as shown in FIG. 13.

An interlocking means again serves to releasably couple the two buckle components 30*a*, 30*b* in the assembled state. The interlocking means of buckle 30 comprises a pair of laterally projecting wings 32 on component 30*a* and a pair of forwardly projecting resilient prongs 34 on component 30*b*.

The wings 32 each have mutually spaced panels 32*a*, 32*b* defining passages 36 therebetween. Passages 36 lead to aligned locking surfaces, which in this case are the peripheral edges of apertures 38 in the wing panels 32*a*, 32*b*.

Figure 16:
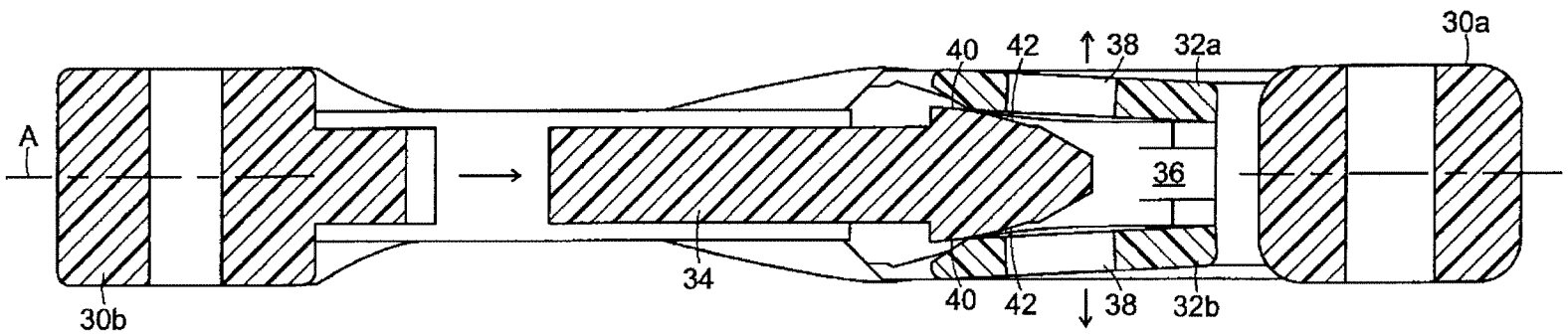
FIG. 16 is a longitudinal sectional view depicting the spreading of the resilient wing panels of the embodiment depicted in FIG. 9-15 during assembly of the buckle components.

The prongs 34 have oppositely projecting posts 40 and first and second cam surfaces 42, 44. With reference to FIG. 16, as the buckle components 30*a*, 30*b*, are brought together along axis A, the first cam surfaces 42 urge the wing panels 32*a*, 32*b* apart to accommodate insertion of the prongs 34 into the passages 36. As the prongs 34 pass by the panel apertures 38, the posts 40 are received in the apertures and are snap engaged by the aperture edges, resulting in the two buckle components being interlocked in the assembled state depicted in FIGS. 9-11.

In order to disassemble the buckle components 30*a*, 30*b*, the resilient prongs 34 are pressed inwardly towards axis A. This causes the second cam surfaces 44 to spread the wing panels 32*a*, 32*b* apart, which relieves the engagement of the posts 40 in the panel apertures 38, thereby allowing the posts 40 to be withdrawn from the passages 36.

Buckle component 30*a* may advantageously be provided with a centrally projecting nose 46 configured to be received in a centrally located U-shaped recess 48 defined by laterally spaced guide bars 50 on buckle component 30*b*. A peripheral groove 52 on nose 46 coacts with a peripheral rib 54 extending around the interior of recess 48 to locate and guide the buckle components during assembly and disassembly.

The invention claimed is:

1. A buckle comprising two components relatively shiftable along a central axis into and out of an assembled state, with one wing on each of said components, said wings having opposed mutually spaced resilient panels defining passages therebetween leading to aligned locking surfaces on said panels, and at least one resilient prong on each of said components, said prongs having oppositely protruding posts and first and second cam surfaces, said first cam surfaces being configured and arranged to urge said panels apart and thereby accommodate insertion of said prongs into said passages to locked positions at which said posts are in snap engagement with said locking surfaces, said second cam surfaces being configured and arranged to act in response to flexure of said prongs towards said central axis to urge said panels apart and to thereby accommodate withdrawal of said prongs from said passages by being pressed inwardly towards the central axis.

2. The buckle of claim 1 wherein a pair of said wings are provided on said one component, and a pair of said prongs are provided on said other component.

3. The buckle of claim 2 wherein said pair of wings are separated by a centrally projecting nose, and wherein said pair of prongs are separated by a U-shaped recess configured and dimensioned to receive said nose.

4. The buckle of claim 1 or 2 wherein said panels are provided with openings for receiving said posts, and wherein said locking surfaces are defined by edges of said openings.

5. The buckle of claim 1 where said locking surfaces are defined by peripheral edges of said panels.

6. The buckle of claim 1 wherein said second cam surfaces are provided on said posts.

7. The buckle of claim 1 wherein said second cam surfaces are provided on said prongs.

8. The buckle of claim 1 wherein said first and second components are identical.

9. A buckle comprising two identical components relatively shiftable along a central axis into and out of an assembled state, with a wing on each of said components, said wings having opposed mutually spaced resilient panels defining passages therebetween leading to aligned locking surfaces on said panels, and a resilient prong on each of said components, said prongs having oppositely protruding posts and first and second cam surfaces, said first cam surfaces being configured and arranged to urge said panels apart and thereby accommodate insertion of said prongs into said passages to locked positions at which said posts are in snap engagement with said locking surfaces, said second cam surfaces being configured and arranged to act in response to flexure of said prongs towards said central axis to urge said panels apart and to thereby accommodate withdrawal of said prongs from said passages by being pressed inwardly towards the central axis.

10. A buckle comprising two identical components relatively shiftable along a central axis into and out of an assembled state, with a wing on each of said components, said wings having opposed mutually spaced resilient panels defining passages therebetween leading to aligned back edges of said panels, and a resilient prong on each of said components, said prongs having oppositely protruding posts and first and second cam surfaces, said first cam surfaces being configured and arranged to urge said panels apart and thereby accommodate insertion of said prongs into said passages to locked positions at which said posts are in snap engagement with the back edges of said panels, said second cam surfaces being configured and arranged to act in response to flexure of said prongs towards said central axis to urge said panels apart and to thereby accommodate withdrawal of said prongs from said passages by being pressed inwardly towards the central axis.

* * * * *